US007734236B2

(12) United States Patent
Sakuma

(10) Patent No.: US 7,734,236 B2
(45) Date of Patent: Jun. 8, 2010

(54) BELT UNIT AND IMAGE FORMING APPARATUS USING THE SAME

(75) Inventor: Tetsushi Sakuma, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 76 days.

(21) Appl. No.: 12/232,260

(22) Filed: Sep. 12, 2008

(65) Prior Publication Data

US 2009/0087233 A1 Apr. 2, 2009

(30) Foreign Application Priority Data

Sep. 14, 2007 (JP) ..... P2007-238615
Feb. 22, 2008 (JP) ..... P2008-040911

(51) Int. Cl.
*G03G 15/01* (2006.01)
*G03G 15/08* (2006.01)

(52) U.S. Cl. ..... 399/302; 399/121

(58) Field of Classification Search ..... 399/107, 399/111, 121, 302, 308
See application file for complete search history.

(56) References Cited

U.S. PATENT DOCUMENTS 7,085,517 B2 * 8/2006 Sameshima ..... 399/111
2008/0219715 A1 * 9/2008 Park ..... 399/302

FOREIGN PATENT DOCUMENTS

| | | |
|---|---|---|
| JP | 4-98284 | 3/1992 |
| JP | 5-303314 | 11/1993 |
| JP | 200-106319 | 4/2001 |
| JP | 2004-51299 | 2/2004 |
| JP | 2004-101599 | 4/2004 |
| JP | 2005-148675 | 6/2005 |
| JP | 2005-257863 | 9/2005 |
| JP | 2005-292480 | 10/2005 |
| JP | 2006-65056 | 3/2006 |

* cited by examiner

*Primary Examiner*—Hoang Ngo
(74) *Attorney, Agent, or Firm*—McGinn IP Law Group, PLLC

(57) ABSTRACT

According to an aspect of the present invention, there is provided a belt unit including: a belt that is formed in an endless shape; a first roller that supports the belt from an inner side of the belt; a second roller that supports the belt from the inner side of the belt; regulation walls that are disposed on both sides of the second roller and that each includes a boss protruding outwardly, the boss having a tapered portion; and plate frames that are disposed on both sides of the belt and that each includes: a first groove portion that supports the first roller; and a second groove portion that supports the second roller, the second groove portion having a rounded edge formed to be run on by the boss through the tapered portion.

9 Claims, 6 Drawing Sheets

BELT UNIT AND IMAGE FORMING APPARATUS USING THE SAME

CROSS-REFERENCE TO RELATED APPLICATIONS

This application claims priority from Japanese Patent Application No. 2007-238615 filed on Sep. 14, 2007, and from Japanese Patent Application No. 2008-040911 filed on Feb. 22, 2008, the entire contents of which are incorporated herein by reference.

BACKGROUND OF THE INVENTION

1. Field of the Invention

An aspect of the present invention relates to a belt unit and an image forming apparatus using the same.

2. Description of the Related Art

An image forming apparatus is generally classified into a tandem image forming apparatus and an image forming apparatus of four-rotation type. In the tandem image forming apparatus, an intermediate transfer element or a transfer belt for sheet conveyance purpose is used. The transfer belt usually rotates upon receipt of rotational force from at least one drive roller supporting a belt. Meanwhile, in the four-rotation type image forming apparatus, a transfer belt to which tensile force is applied and in which a drive roller is equipped is used as an intermediate transfer element.

When one of the rollers equipped in the transfer belt are twisted with respect to the other one during the transferring operation, the transfer belt moves in a direction orthogonal to the rotational direction; that is, so-called deviation to one side occurs. A method for bringing a flange into contact with an end face of the transfer belt, to thus regulate deviation of the belt, is generally used frequently to prevent deviation of the transfer belt.

As another method for preventing deviation of a belt, a steering roller is used as one of rollers among which a transfer belt is suspended (see; for example, JP-2005-292480-A and JP-2006-65056-A). According to the method, the steering roller is provided, and hence, when the transfer belt deviates to one side, one roller shaft is tilted by a motor, thereby making a correction to movement of the transfer roller in an opposite direction.

All of the above-described related-art methods present a problem in terms of the durability of the belt and the cost of components. According to the method that brings the flange into contact with the end face of the belt, the end of the belt keeps performing movement while contacting the flange, so that the end of the belt will wear out and encounter a decrease in durability. When force for moving the belt in one direction becomes greater, abrasion or cracking (rupture) takes place in the end of the transfer belt, which in turn induces variations in rotation of the transfer belt or sometimes cause defects in an image. Therefore, to reduce the deviation force on the belt, it is generally required to manage, with high accuracy, a difference between right and left belts in terms of a peripheral length, the thickness of the belts, and alignment among rollers. The necessary entails an increase in the price of components and presents an obstacle in cost reduction.

In the meantime, according to the method providing the steering roller, a sensor for detecting the position of the end of the belt, a motor for tilting the roller shaft, a controller for controlling the motor in accordance with information detected by the sensor, and the like, are required. Therefore, the number of components is increased, which in turn entails an increase in the size and cost of the apparatus.

SUMMARY OF THE INVENTION

According to an aspect of the present invention, there is provided a belt unit including: a belt that is formed in an endless shape; a first roller that supports the belt from an inner side of the belt; a second roller that supports the belt from the inner side of the belt; regulation walls that are disposed on both sides of the second roller and that each includes a boss protruding outwardly, the boss having a tapered portion; and plate frames that are disposed on both sides of the belt and that each includes: a first groove portion that supports the first roller; and a second groove portion that supports the second roller, the second groove portion having a rounded edge formed to be run on by the boss through the tapered portion.

According to another aspect of the present invention, there is provided a belt unit including: regulation walls that are formed to regulate a side deviation of a belt in a direction perpendicular to a rotational direction of the belt and that each includes a boss protruding outwardly, the boss having a tapered portion; and plate frames that each includes groove portion having a rounded edge formed to be run on by the boss through the tapered portion in accordance the side deviation of the belt.

According to still another aspect of the present invention, there is provided an image forming apparatus including the belt unit as described above.

BRIEF DESCRIPTION OF THE DRAWINGS

Embodiments of the present invention will be described in detail based on the following figures, wherein.

DETAILED DESCRIPTION OF THE INVENTION

An embodiment of the present invention will be described hereunder by reference to FIGS. 1 through 8. First, the summary of an electrophotographic apparatus of the present invention will be described by use of FIG. 1 showing a diagrammatic cross section of the apparatus.

Figure 1:
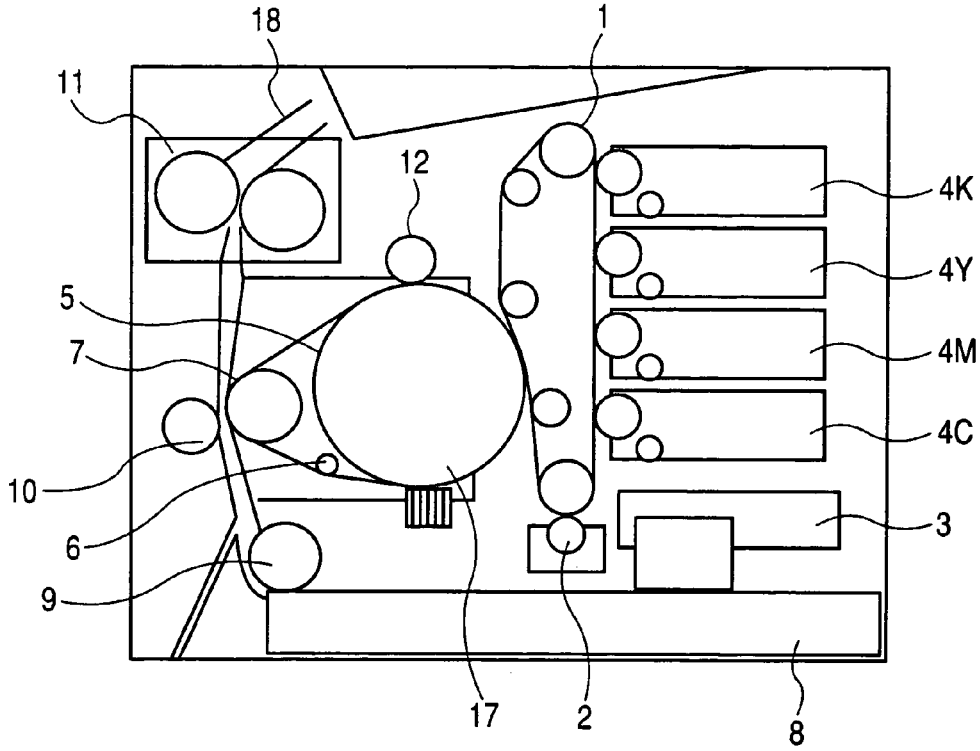
FIG. 1 is a diagrammatic cross-sectional view of an image forming apparatus of the embodiment.

As shown in FIG. 1, an intermediate transfer unit 17 is placed at the center of the apparatus, and a photosensitive member 1, a transfer roller 10, and a cleaner 12 are arranged around the intermediate transfer unit 17. An electric charger 2 is also disposed around the photosensitive member 1. Developing devices 4K, 4Y, 4M, and 4C filled with toner that is different four colors of colored fine powders are placed sequentially along the photosensitive member 1. An exposing device 3 is disposed beneath the developing devices, and sheet holder 8 that holds a sheet and a sheet feeding device 9 are also positioned below the exposing device 3. A fixing unit 11 and a sheet discharging device 18 are positioned in an upper portion of the electrophotographic apparatus.

In such a configuration, the electric charger 2 uniformly charges the surface of the photosensitive member 1. Next, based on information of an image or letters acquired by a personal computer, an image scanner, and the like, the exposing device 3 performs exposure on a per-dot basis, to thus form an electrostatic latent image on the surface of the photosensitive member 1. Subsequently, toner is applied by the respective one of the developing devices 4K, 4Y, 4M, and 4C to develop an electrostatic latent image, whereby a toner image is visualized and the thus-visualized image is conveyed to the intermediate transfer unit 17.

By repeating the above-mentioned process for each developing devices 4K, 4Y, 4M, and 4C, a toner image conforming to the information of the image or the letters is formed on a surface of the intermediate transfer unit 17. Subsequently, the toner image is transferred by a transfer roller 10 onto a sheet fed from the sheet holder 8 by the sheet feeding device 9. The toner left on the intermediate transfer unit 17 is cleaned by the cleaner 12. The sheet with the toner image transferred thereon is conveyed to the fixing unit 11, where the toner image is fixed on the sheet and discharged by the sheet discharging device 18.

Figure 2:
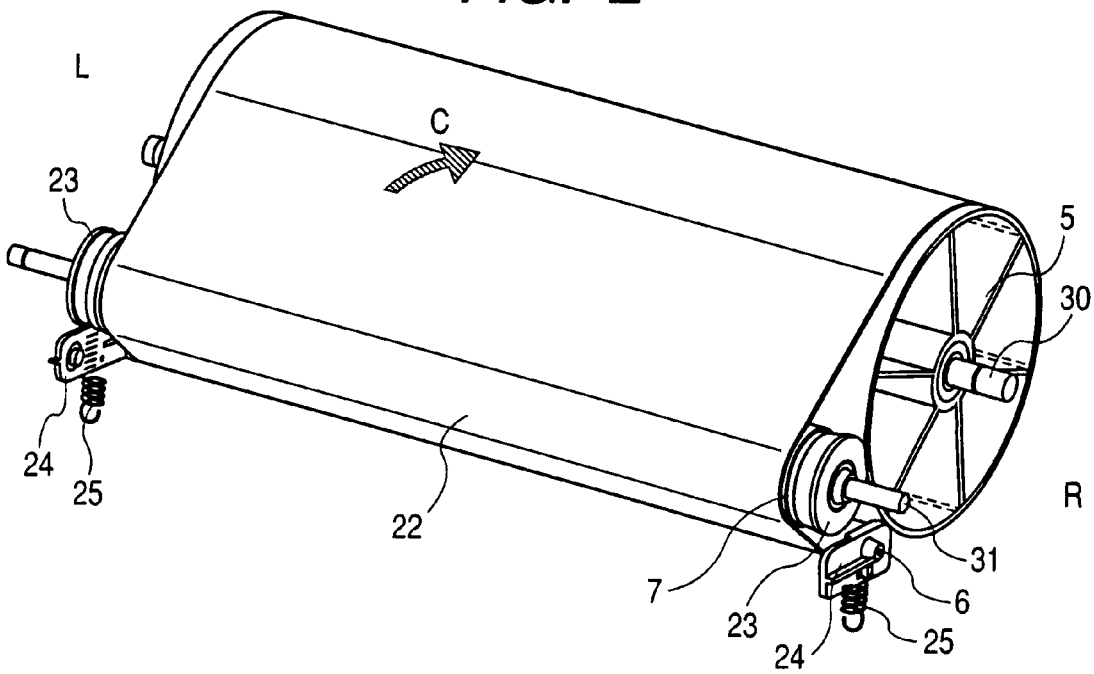
FIG. 2 is a perspective view of an intermediate transfer unit of the embodiment.
Figure 3:
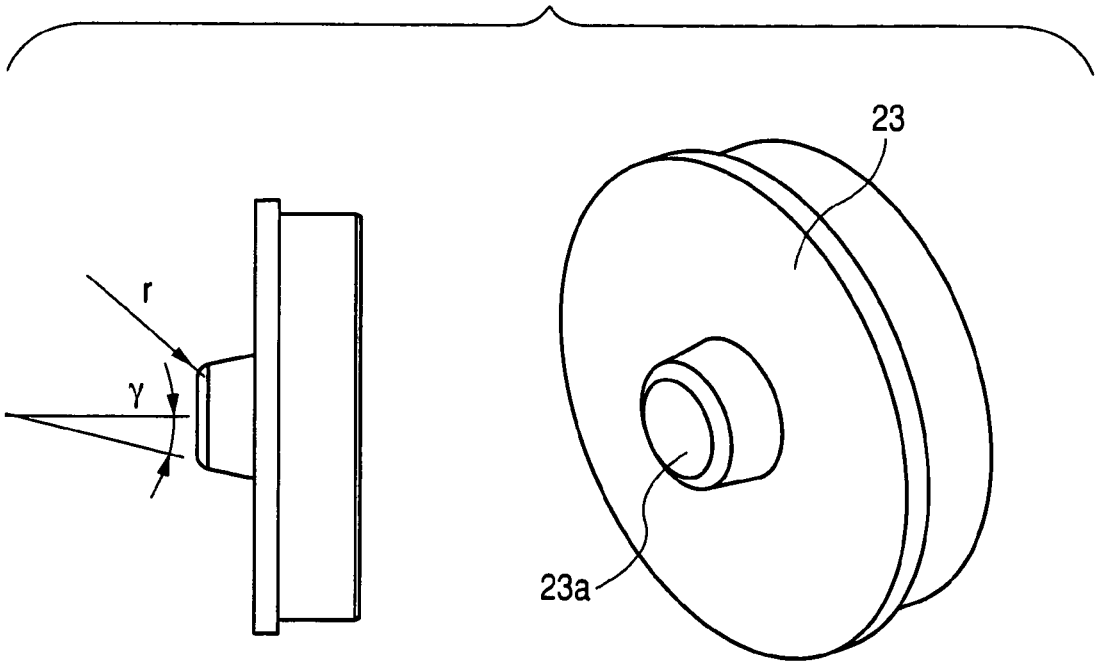
FIG. 3 is a perspective view of a regulation wall of the embodiment.
Figure 4:
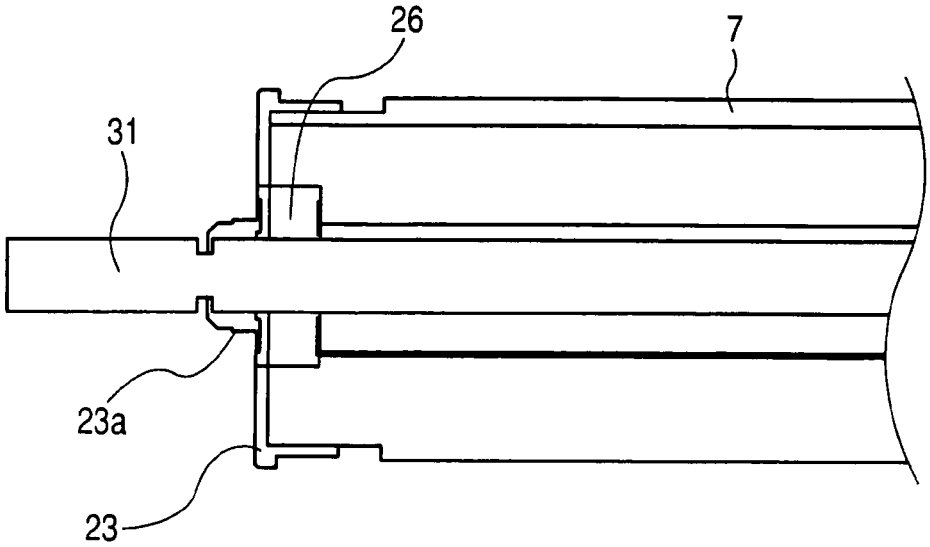
FIG. 4 is a cross-sectional view of a small roller of the embodiment.

The intermediate transfer unit as a belt unit in the electrophotographic apparatus of the embodiment will now be described by reference to FIGS. 2, 3 and 4 showing general views of the apparatus.

FIG. 2 is a perspective view of the intermediate transfer unit 17. The intermediate transfer unit 17 is made up of a large roller 5, a tension roller 6, a small roller 7, a large roller shaft 30 on which the large roller 5 is supported, a small roller shaft 31 on which the small roller 7 is supported, a transfer belt 22, regulation walls 23, tension arms 24, and tension springs 25. The transfer belt 22 rotates in a direction of arrow C in the drawings.

FIG. 3 is a detailed perspective view of the regulation wall 23, wherein reference symbol γ denotes a cone angle of a boss 23*a* and "r" denotes a curvature of the tip end of the boss. When the transfer belt 22 shown in FIG. 2 deviates to one side, the boss 23*a* contacts a small-roller-supporting fitting groove 41 (herein after simply called "fitting groove") of a side plate frame 32 shown in FIG. 5, thereby running upon the fitting groove 41.

FIG. 4 is a cross-sectional view of the small roller 7. The small roller 7 is supported by the small roller shaft 31 through ball bearings 26. The large roller 5 shown in FIG. 2 is supported by the large roller shaft 30 shown in FIG. 2 through the ball bearings 26.

Figure 5:
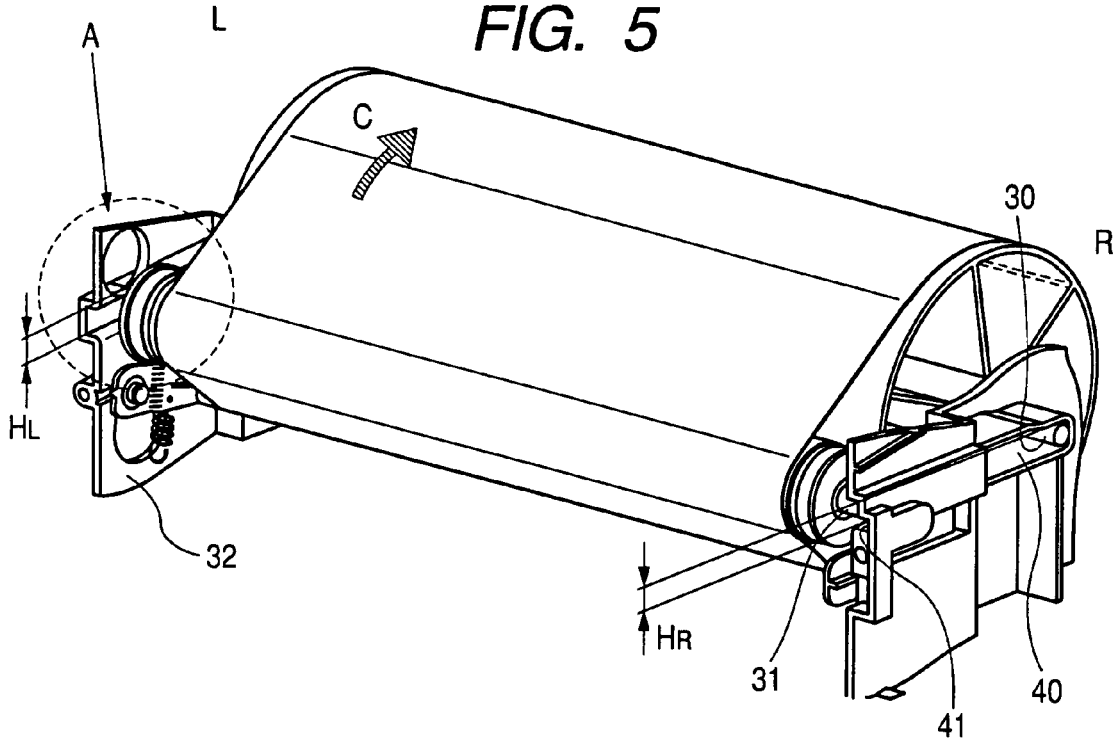
FIG. 5 is a descriptive view showing the arrangement of respective rollers and fitting grooves of side plate frames of the embodiment.

As shown in FIG. 2, in this embodiment, the transfer belt 22 is made from a PC alloy and has a thickness of 0.15 mm, a width of 250 mm, and a peripheral length of 380 mm. The large roller 5 is made from aluminum and has a diameter of 104.8 mm. The small roller 7 is made from aluminum and has a diameter of 30 mm. The large roller shaft 30, the small roller shaft 31, and the tension arm 24 are supported on side plate frames 32 as shown in FIG. 5. The large roller shaft 30 and the small roller shaft 31 support the large roller 5 and the small roller 7 through the ball bearings 26 as shown in FIG. 4 and hence does not rotate with respect to the side plate frames 32 shown in FIG. 5. The tension roller 6 is made from aluminum and has a diameter of 12 mm. The regulation walls 23 are formed from polyacetal. A deviation preventing flange (herein after simply called "flange") of the transfer belt 22 has an outer diameter of 33 mm; the base diameter of the boss is 9.0 mm; the cone angle γ of the boss is 10°; and a tip end of the boss has a curvature of 1.0 mm. The tension spring 25 is formed from SWPB and has a spring constant of 0.7 N/mm.

The intermediate transfer unit 17 does not have drive source and is configured so as to rotate in a following manner upon receipt of rotational force from the photosensitive member 1. To this end, a nip width of a first transfer section that contacts the photosensitive member 1 is widely ensured. In order to achieve optimum operation, it is better to ensure a value of 10 mm or more for the nip width of the first transfer section. In this embodiment, a nip width of about 24 mm is adopted. The transfer belt 22 is suspended and supported by at least two of rollers including the large roller 5 and the small roller 7. The large roller 5 that is closer to the photosensitive member 1 is configured to have large diameter to provide a wide nip width. Since the transfer belt 22 serving as an intermediate transfer member is configured to contact with and to be rotated by the photosensitive member 1, there is arranged a tension roller 6 that applies a moderate tensile force enough to remove slack to the transfer belt 22. The tension roller 6 is supported by a tension arm 24. A tension spring 25 supporting the tension arm 24 is configured so as to exert load on the tension roller 6. A detailed configuration will be described later.

A method for reducing the deviation of the transfer belt of the embodiment will now be described by reference to FIGS. 5, 6, and 7 that show an overview of the method.

First, a twist in the small roller shaft (herein after called a "small roller shaft twist") with respect to the large roller shaft and deviation of the belt will be described by reference to FIG. 5. Large-roller-supporting Fitting grooves 40 (herein after called "fitting grooves 40") of the side plate frames 32 support the large roller shaft 30. Small-roller-supporting fitting grooves 41 (herein after called "fitting grooves 41") of the side plate frames 32 support the small roller shaft 31. Arrow C designates the rotational direction of the transfer belt 22. Reference symbol HL designates a distance between the fitting groove 40 of a side plate frame 32L and the fitting groove 41 of the side plate frame 32L. Reference symbol HL designates a distance between the fitting groove 40 and the fitting groove 41 at the L-side plate frame 32L. Reference symbol HR designates a distance between the fitting groove 40 and the fitting groove 41 at the R-side plate frame 32R. ΔH (=HR−HL) designates a difference between HL and HR. In this embodiment, ΔH<0.3 mm is achieved.

ΔT designates an twisting amount in the small roller shaft. ΔT=ΔH is achieved in a state where the large roller shaft 30 and the small roller shaft 31 are supported by the fitting grooves of the side plate frames 32.

In the case of ΔT=ΔH>0 (HR>HL), when the transfer belt 22 is rotated so as to follow the photosensitive member 1, the transfer belt 22 rotates while causing out-of-plane deformation. At this time, deviation force toward the L side is generated in the transfer belt 22, whereupon the transfer belt 22 moves to the L side. Conversely, in the case of ΔT=ΔH<0, (HR<HL) deviation force to the R side is generated in the transfer belt 22, whereupon the transfer belt 22 moves to the R side.

Figure 6:
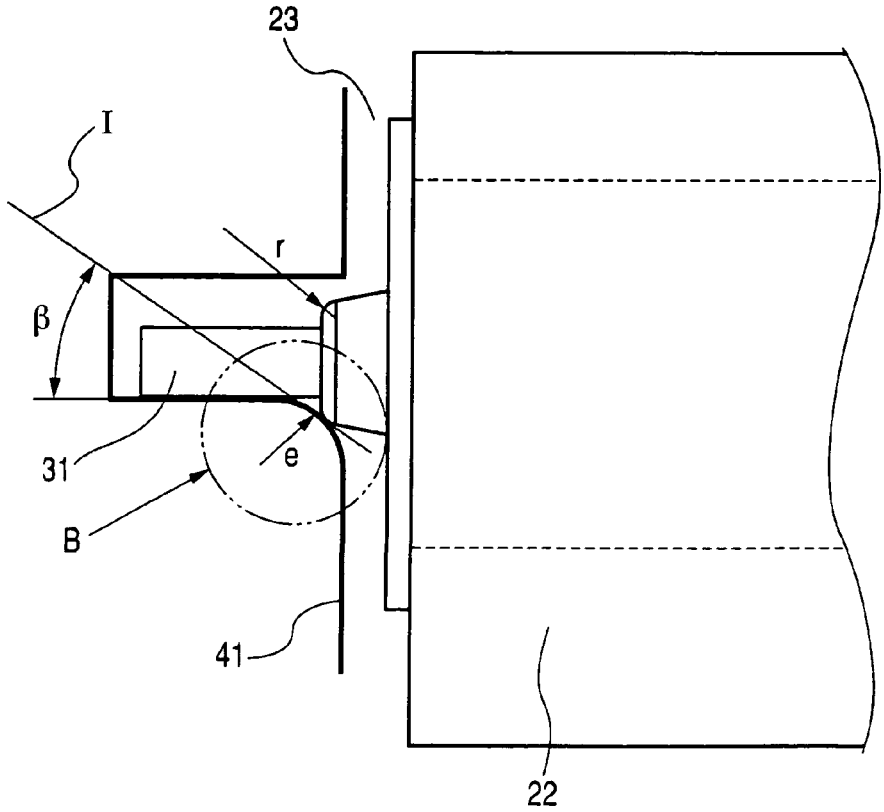
FIG. 6 is a view showing the arrangement of a boss of the regulation wall and the fitting groove of the side plate frame.

FIG. 6 is an enlarged view of a section A in FIG. 5, showing that the transfer belt 22 remains deviated to the L side and in contact with the regulation wall 23. Reference symbol "l" designates a tangential line at a contact point between the boss 23*a* of the regulation wall 23 and the fitting groove 41. Reference symbol β designates an angle formed by the tangential line "l" and the surface of the fitting groove 41 of the side plate frame 32. Reference symbol "r" designates a curvature of the tip end of the boss of the regulation wall 23. Reference symbol "e" designates a curvature of a section B in the fitting groove 41.

Figure 7:
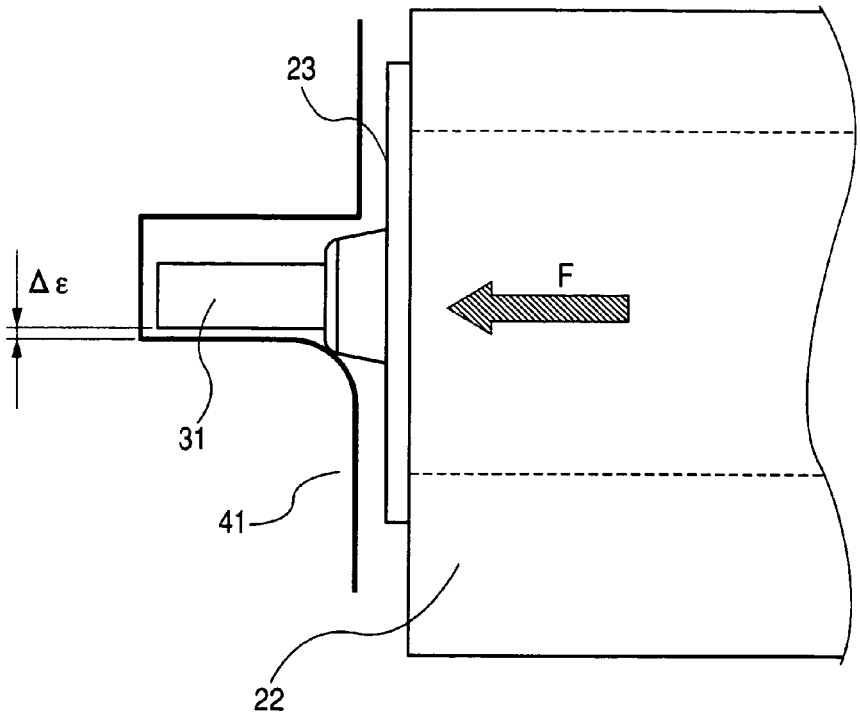
FIG. 7 is a view showing that the boss of the regulation wall remains struck on the fitting groove of the side plate frame.

FIG. 7 is a view showing that the boss 23*a* of the regulation wall 23 runs upon the fitting groove 41.

Reference symbol Δϵ designates an amount of the running-on of the boss 23*b* upon the fitting groove 41 (herein after called a "running-on amount"). When the boss of the regulation wall 23 runs upon the fitting groove 41, the striking action can be expressed as $\Delta T=\Delta H-\Delta\epsilon$.

In this embodiment, in the case of $\Delta H>0$, the transfer belt 22 moves to the L side, to thus contact the regulation wall 23. Subsequently, the regulation wall 23 moves to the L side along with the transfer belt 22, thereby contacting the fitting groove 41. On condition that deviation force of the transfer belt 22 (herein after called "belt deviation force") is F and that frictional force developing between the boss of the regulation wall 23 and the fitting groove 41 is M, when $F \cos \beta>M$ is achieved, the regulation wall 23 runs upon the fitting groove 41. ΔT decreases with an increase in the running-on amount Δϵ of the boss, and the belt deviation force F decreases. Deviation of the transfer belt 22 toward the L side starts at a point in time when $F \cos \beta=M$ is satisfied.

Figure 8:
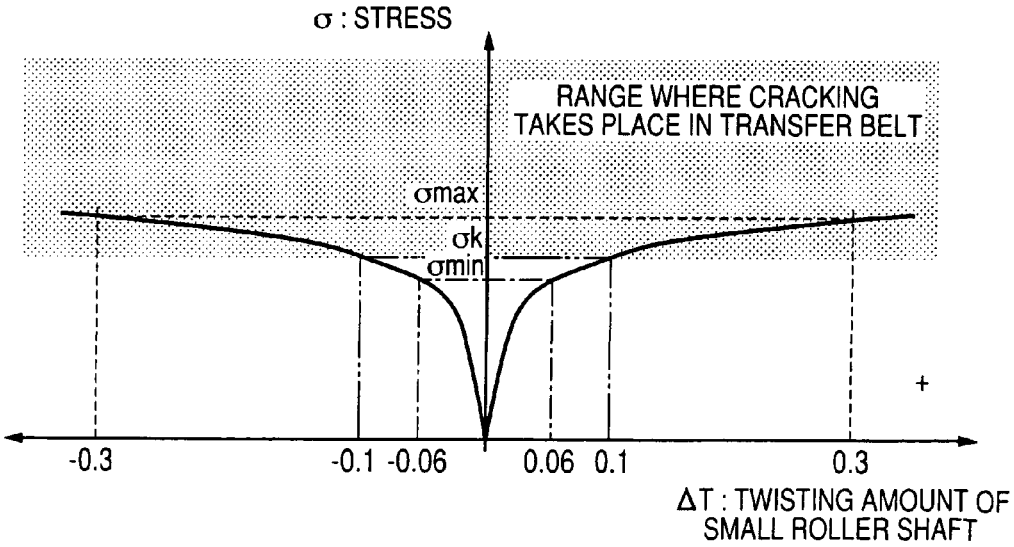
FIG. 8 is a view showing a relationship between the twisting amount in a small roller shaft and belt end stress.

FIG. 8 shows a relationship between the twisting amount ΔT in the small roller shaft and stress σ that is generated in the end of the transfer belt 22 when the end of the transfer belt 22 collides with the regulation wall 23 (herein after called "belt end stress").

Reference symbol σk designates allowable stress at which the transfer belt 22 can fulfill its specification life. Reference symbol σmax designates belt end stress σ achieved when the twisting amount ΔT in the small roller shaft is maximum.

In this embodiment, $|\Delta T|<0.3$ mm is satisfied at a non-operating state. Reference symbol σmin designates stress σ of the transfer belt 22 arising when $F \cos \beta=M$ is achieved.

According to the configuration, even when a height difference ΔH arises in the right and left fitting grooves 41 and when the belt end stress σ is σk or greater, the boss of the regulation wall 23 runs onto the fitting groove 41 along the tapered boss 23*a* of the regulation wall 23. When the transfer belt 22 starts deviating as a result of $F \cos \beta=M$ being achieved, $\sigma<\sigma k$ is attained. Consequently, occurrence of abrasion or cracking (rupture) in the transfer belt 22, variations in rotation of the transfer belt, and defects in an image can be prevented. A relationship between the end stress σ of the transfer belt 22 and the twisting amount ΔT in the small roller shaft, the shape of the boss 23*a* of the regulation wall 23, and the frictional force M generated between the boss 23*a* and the fitting groove 41 will be described in detail later.

<Relationship Between the Twisting Amount in the Small Roller and the Transfer Belt End Stress>

A relationship between the twisting amount ΔT in the small roller shaft and the belt end stress σ will be described by reference to FIG. 8.

FIG. 8 is a view showing a relationship between the twisting amount ΔT in the small roller shaft and the belt end stress σ.

A horizontal axis represents the twisting amount ΔT in the small roller shaft. When the R side of the small roller shaft is higher than the large roller shaft, the amount is designated with a positive (plus) sign. When the L side of the same is higher, the amount is designated with a negative (minus) sign. A vertical axis represents stress σ in the end of the transfer belt 22.

In the case of $\Delta T=0$ [mm], belt deviation force F=0 [N] and belt end stress σ=0 [MPa] are achieved. However, in the case where $\Delta T\neq 0$ [mm], belt deviation force is generated. For instance in the case of $\Delta T=0.06$ [mm], belt end stress σ=2.1 [MPa] is achieved. In the case of $\Delta T=0.1$ mm or more, belt end stress σ> allowable belt stress σk=2.5 [MPa] is occurred, and abrasion or cracking (rupture) takes place in the end of the transfer belt 22. Further, variations arise in the rotation of the transfer belt 22, and defects may arise in an image.

<About a Cone Angle of the Boss of the Regulation Wall>

A relationship between the cone angle γ of the boss of the regulation wall 23 and the deviation force F on the transfer belt 22 will be described by reference to FIG. 6.

When the deviation force of the transfer belt 22 is F [N], force of $F \cos \beta$ [N] acts in the direction of the tangential line "l" when the boss 23*s* of the regulation wall 23 collides with the fitting groove 41. In the meantime, when the boss of the regulation wall 23 runs upon the fitting groove 41, frictional force M is generated between the boss 23*a* and the fitting groove 41. In the case of $F \cos \beta>M$, the boss 23*a* runs upon the fitting groove 41.

In the embodiment, frictional force M generated between the boss 23*a* and the fitting groove 41 assumes a value of 9 [N]. In the regulation wall 23, the cone angle γ of the boss 23*a* is 10°, and the curvature "r" of the tip end of the boss 23*a* is 1 [mm]. A curvature "k" of the section B in the fitting groove is 3 [mm]. In this case, an angle β formed by the tangential line "l" at a contacting point between the tip end of the boss 23*a* and the section B of the fitting groove 41 and the surface of the fitting groove 41 assumes a value of 40°. In the case of belt deviation force F>12.7 [N], the boss of the regulation wall 23 runs upon the fitting groove 41. Further, as a result of the boss of the regulation wall 23 running upon the fitting groove 41, the belt deviation force F decreases. At the time when the belt deviation force F assumes a value of 12.7 [N], the belt deviation stops and ΔT assumes a value of 0.06 mm.

When the cone angle γ of the boss 23*a* assumes a value of 6° or less, the value of the angle β becomes great, and the force $F \cos \beta$ at which the boss of the regulation wall 23 attempts to run upon the fitting groove 41 becomes small. In this case, $F \cos \beta<M$ is attained, and the boss of the regulation wall 23 cannot run upon the fitting groove 41. In the case of $\Delta T>0.1$ mm, belt end stress σ> allowable belt stress σk is attained. Hence, it becomes impossible to prevent occurrence of abrasion or cracking (rupture) in the transfer belt, variations in the rotation of the transfer belt, and defects in an image.

By setting the cone angle γ of the boss 23*a* to be equal to or greater than 6°, the boss 23*a* becomes easy to run upon the groove, and the belt deviation force can be diminished.

From the above descriptions, in this embodiment, as a result of achievement of a relationship of angle γ>6°, the deviation of the transfer belt 22 can be reduced, and occurrence of abrasion or cracking (rupture) in the transfer belt 22, variations in the rotation of the transfer belt 22, and defects in an image can be prevented.

<In the Case where the Intermediate Transfer Unit is Driven>

The intermediate transfer unit 17 is taken as being driven in this embodiment. Even when the large roller 5 or the small roller 7 of the intermediate transfer unit 17 is driven, the deviation force acting on the transfer belt 22 can be reduced by adoption of a similar configuration, and occurrence of abrasion or cracking (rupture) in the transfer belt 22, variations in the rotation of the transfer belt 22, and defects in an image can be prevented.

<In the Case of a Tandem Type>

The color imaging forming apparatus of this embodiment is of a four rotation type, and the transfer belt 22 is used as an intermediate transfer element. However, even when the transfer belt 22 is used as an intermediate transfer element or for the purpose of conveying a sheet in an image forming apparatus of a tandem type, adoption of a similar configuration results in a reduction in the deviation of the transfer belt 22 and enables prevention of occurrence of abrasion or cracking (rupture) in the transfer belt 22, variations in the rotation of the transfer belt 22, and defects in an image.

A case where the belt unit is used for a fixing unit will now be described as another embodiment of the present invention by reference to FIGS. 9 through 12. Even when the regulation walls 23 of the above embodiment are used in the intermediate transfer unit 17, even a fixing unit using a belt can also prevent occurrence of abrasion or cracking (rupture) in a belt and defects in an image by adapting a similar configuration.

Figure 9:
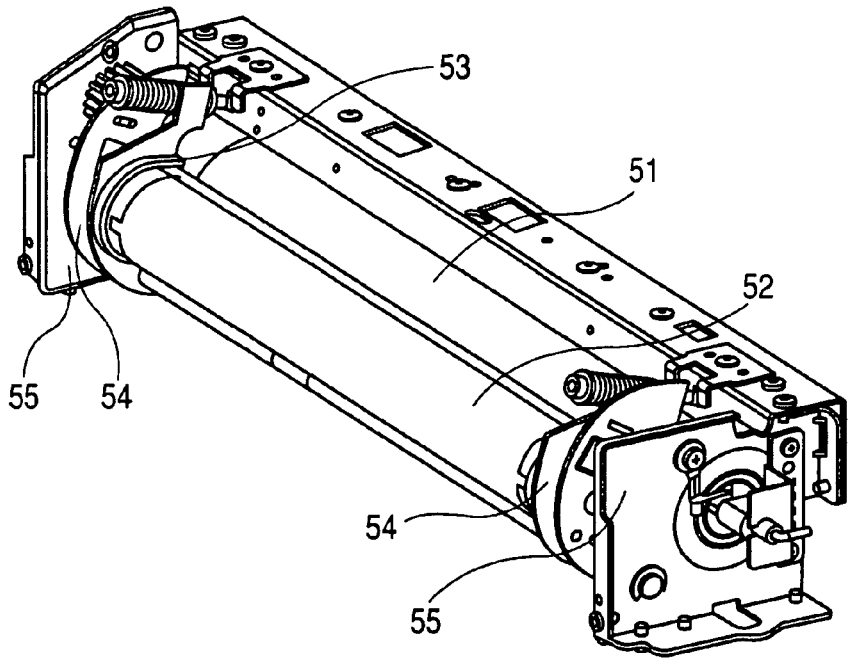
FIG. 9 is a perspective view of a fixing unit of the embodiment.

FIG. 9 shows a perspective view of the fixing unit. The fixing unit is made up of a heating roller 51, a pressure belt 52, deviation regulation walls 53, pressure frames 54, and plates 55. The drawing shows the arrangement of these elements. The heating roller 51 is rotatably supported by the plates 55 and rotated by, for example, an unillustrated gear. The pressure belt 52 is rotated by the rotational drive force of the heating roller 51.

The pressure belt 52 is suspended by the pressure unit and is brought into contact with the heating roller 51 by the pressure springs, or the like, while a shaft provided on the plates 55 is taken as a base point.

Figure 10:
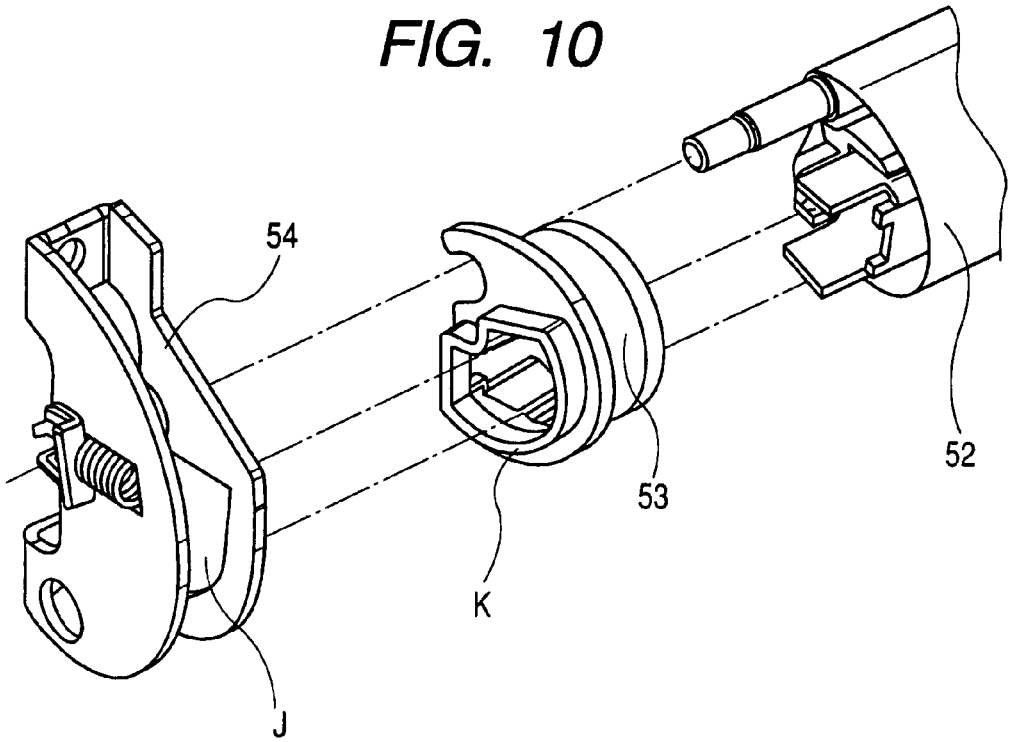
FIG. 10 is a view showing the layout of a pressure belt, a deviation regulation wall, and a pressure frame of the embodiment.

FIG. 10 shows the layout of the pressure belt 52, the deviation regulation walls 53, and the pressure frames 54. Each of the deviation regulation walls 53 that end faces of the pressure belt 52 contact has at one end face an essentially-cylindrical guide section for guiding an interior surface of the pressure belt 52 and at the other end face a boss K. The boss K is configured so as to be supported by a fitting groove J of the pressure frame 54.

Figure 11:
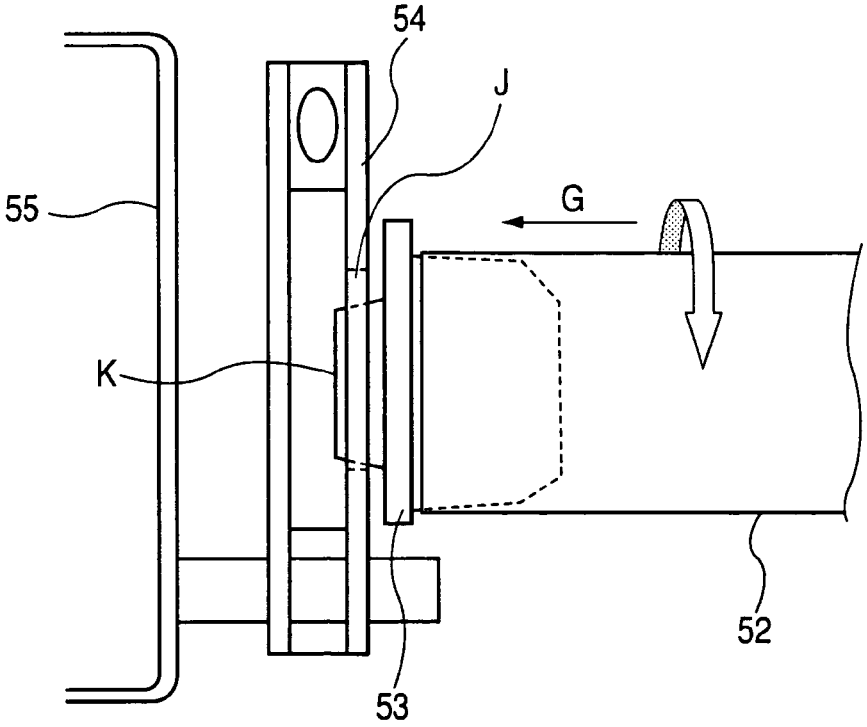
FIG. 11 is a view showing the arrangement of a boss of the deviation regulation wall, the pressure belt, the pressure frame, and the plate.

FIG. 11 shows the arrangement of the boss K of the deviation regulation wall 53, the pressure belt 52, the pressure frame 54, and the plate 55, as well as showing that the pressure belt 52 deviates to in the direction of arrow G for reasons of distortion of the plate 55.

Figure 12:
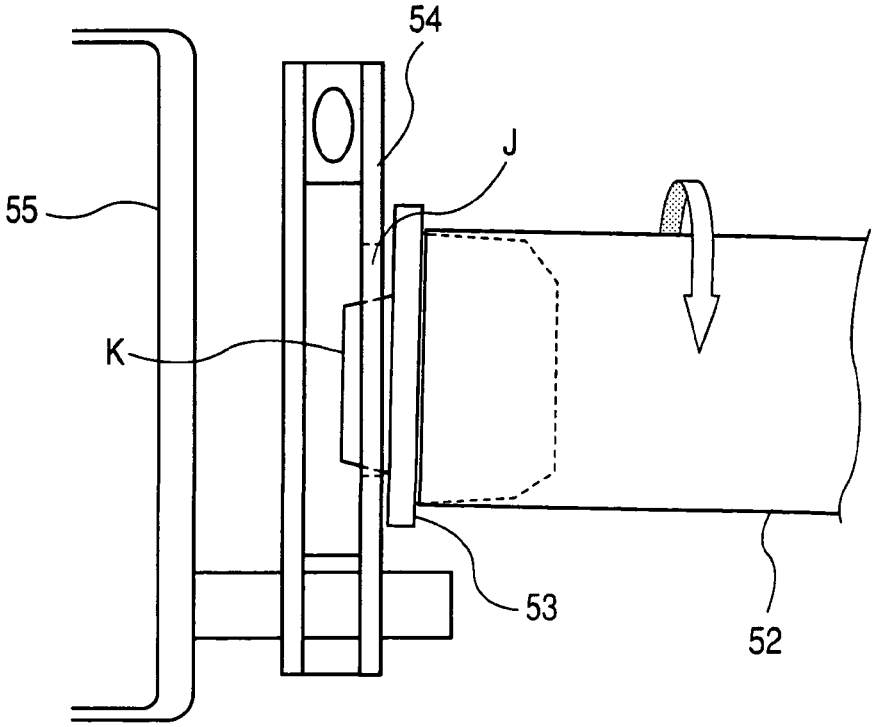
FIG. 12 is a view showing that the boss of the deviation regulation wall struck on the fitting groove of the pressure frame.

FIG. 12 shows that the boss K of the deviation regulation wall 53 runs upon the fitting groove J of the pressure frame 54 by the belt deviation force acting on the pressure belt 52. Thus, the belt deviation force acting on the pressure belt 52 attributable to the distortion of the plate 55 can be diminished.

As mentioned above, the pressure frame is embodied in the form of a side plate frame even in the fixing unit, whereby the belt deviation force acting on the pressure belt 52 is lessened, and abrasion or cracking (rupture) in the pressure belt 52, wrinkles in paper incident to movement of the pressure belt 52 in the thrust direction, a paper jam which becomes likely to arise as a result of occurrence of abrasion or cracking (rupture) in the pressure belt 52, and the like, can be prevented.

According to an aspect of the present invention, deviation of a belt is regulated, while suppressing an increase in the number of components and accomplishing low-cost configuration of an intermediate transfer unit and a fixing unit, thereby providing an image forming apparatus having high image quality without variations in an image.

What is claimed is:

1. A belt unit comprising:

a belt that is formed in an endless shape;

a first roller that supports the belt from an inner side of the belt;

a second roller that supports the belt from the inner side of the belt;

regulation walls that are disposed on both sides of the second roller and that each includes a boss protruding outwardly, the boss having a tapered portion; and plate frames that are disposed on both sides of the belt and that each includes:

a first groove portion that supports the first roller; and a second groove portion that supports the second roller, the second groove portion having a rounded edge formed to be run on by the boss through the tapered portion.

2. The belt unit according to claim 1, wherein the boss runs on the rounded edge at the tapered portion when the second roller is tilted by a side deviation of the belt.

3. The belt unit according to claim 1, wherein the regulation walls are configured to be pivotable in a thrust radial direction independently of the second roller.

4. The belt unit according to claim 1, wherein the tapered portion of the boss is formed to have a cone angle $\gamma$ larger than 6 degrees.

5. The belt unit according to claim 1, wherein the rounded edge is formed to have a curvature r equal to or larger than 1 mm.

6. The belt unit according to claim 1, wherein the regulation walls are formed of a resin having a slidability.

7. The belt unit according to claim 1, wherein the belt includes a transfer belt that is configured to transfer a latent toner image formed on a photosensitive member to a sheet, and wherein the transfer belt is formed of a resin including PC, PI, or PTFE as a base material.

8. A belt unit comprising:

regulation walls that are formed to regulate a side deviation of a belt in a direction perpendicular to a rotational direction of the belt and that each includes a boss protruding outwardly, the boss having a tapered portion; and plate frames that each includes groove portion having a rounded edge formed to be run on by the boss through the tapered portion in accordance the side deviation of the belt.

9. An image forming apparatus including the belt unit according to claim 8.

* * * * *